US006364675B1

(12) United States Patent
Brauer et al.

(10) Patent No.: US 6,364,675 B1
(45) Date of Patent: Apr. 2, 2002

(54) ELECTRICAL CONNECTOR WITH TENSION DISCONNECT

(76) Inventors: Bonnie Brauer, 3835 E. 71st St., Indianapolis, IN (US) 46220; Robert A. Russell, 14439 Plymouth Rock Dr., Carmel, IN (US) 46033

( * ) Notice: Subject to any disclaimer, the term of this patent is extended or adjusted under 35 U.S.C. 154(b) by 0 days.

(21) Appl. No.: 09/731,682

(22) Filed: Dec. 6, 2000

(51) Int. Cl.[7] ..... H01R 13/62
(52) U.S. Cl. ..... 439/159; 439/348
(58) Field of Search ..... 439/159, 152, 439/160, 141, 140, 318, 332–337, 324, 134, 304, 258, 180, 358, 348

(56) References Cited

U.S. PATENT DOCUMENTS

| | | | | |
|---|---|---|---|---|
| 1,572,988 | A | | 2/1926 | Campbell |
| 3,784,958 | A | | 1/1974 | Harris |
| 4,045,106 | A | | 8/1977 | Borg |
| 4,114,969 | A | | 9/1978 | Borg |
| 4,340,267 | A | | 7/1982 | Nukaga |
| 4,684,192 | A | | 8/1987 | Long et al. |
| RE32,864 | E | | 2/1989 | Ezure |
| 4,820,176 | A | | 4/1989 | Niikura |
| 5,171,291 | A | | 12/1992 | d'Alayer de Costemore d'Arc et al. |
| 5,211,569 | A | | 5/1993 | Havens |
| 5,266,040 | A | | 11/1993 | Merrill et al. |
| 5,429,516 | A | | 7/1995 | d'Alayer de Costemore d'Arc et al. |
| 5,480,313 | A | * | 1/1996 | d'Alayer de Costemore d'Arc ..... 439/159 |
| 5,480,314 | A | | 1/1996 | Campbell |
| 5,580,264 | A | * | 12/1996 | Aoyama et al. ..... 439/275 |
| 5,752,842 | A | | 5/1998 | Friederichs et al. |
| 5,800,189 | A | | 9/1998 | Ahmed |
| 6,017,237 | A | * | 1/2000 | Sullivan ..... 439/392 |
| 6,062,883 | A | | 5/2000 | Schreiber et al. |
| 6,123,575 | A | | 9/2000 | Huang et al. |
| 6,165,002 | A | * | 12/2000 | Kalis ..... 439/358 |
| 6,203,353 | B1 | | 3/2001 | Huang et al. |

* cited by examiner

*Primary Examiner*—Tho D. Ta
*Assistant Examiner*—Phuong Nguyen
(74) *Attorney, Agent, or Firm*—Brinks Hofer Gilson & Lione

(57) ABSTRACT

A safety breakaway electric cord mechanism has a specially built plug that can be housed in an appliance such as a coffee maker. The mechanism responds to a tug on the electrical cord by ejecting the cord from the appliance. The user connects the cord into the appliance in a customary straight-in manner. The connection provides a positive locking of the cord to the appliance. The mechanism has a release mechanism that initiates a built-in ejection spring mechanism to force separation of the cord from the appliance.

23 Claims, 7 Drawing Sheets

ELECTRICAL CONNECTOR WITH TENSION DISCONNECT

FIELD OF THE INVENTION

The present invention relates to an electrical connector having two mating assemblies that eject from one another as a result of a tug on a power cord connected to at least one of the connector assemblies.

BACKGROUND OF THE INVENTION

Appliance cords present safety hazards when accidentally subjected to pull forces. Often users will manually pull on a typical 6-foot or 8-foot cord extending from an appliance resulting in abnormal forces at the wall outlet and/or damage to the cord, the outlet, or the appliance itself. It has been reported that on many occasions children have been injured by pulling a hot coffee pot or other similar electrical appliance down on themselves. In other instances, one tripping over a cord may pull the appliance from the shelf.

U.S. Pat. No. 5,480,313 describes an automatic disconnect mechanism for an electrical terminal fitting including a single assembly that springs from electrical engagement with a mating fitting, such as an existing fixed wall socket or the like, in response to a pull on an associated electrical cord. The single assembly includes both the spring to cause separation of the two mated terminal fittings and a trigger mechanism that is actuated by pull forces on the cord to trigger the separation. The mechanism requires the user to pre-set the trigger release which is not automatic. The mechanism does not have a self-locking mechanism actuated upon initial engagement of the terminal fittings. The mechanism generally requires a firm wall socket or other base from which to push-off when disconnecting. The disclosure includes a description of a dangerous situation that can arise with one embodiment in an application to a vehicle under battery charge, where one end would necessarily be left dangling with exposed electrical terminals. In the described situation, although the fitting containing the spring assembly actuates as the vehicle moves off, the electrical prongs of the mating plug fitting are left protruding and electrically exposed.

U.S. Pat. No. 4,114,969 discloses a plug release mechanism designed for use at the plug end of an electrical cord to interact with the structure surrounding a wall outlet in which the plug end is engaged. The device requires manual setting a cam-like actuation rod before use. The device relies on a wall socket-to-plug release in an axial force direction during a tug on the cord. The device does not provide a positive locking mechanism. The device is not designed for application at the appliance, or in-line on a cord.

What is needed is a device that would allow breakaway at an appliance during a tug on the cord. What is also needed is a device with the ability to have a positive locking mechanism while in place. What is also needed is a device that would not present a safety exposure situation when disconnected. What is also needed is a device that would have flexibility of design to allow interfacing to various types of outlets, appliances and yet be simple to manufacture.

SUMMARY OF THE INVENTION

The present invention resolves these problems and satisfies these needs. The present invention provides a quick release breakaway mechanism. The present invention also provides a design that leaves neither end with protruding terminals after disconnecting or when it is in a disconnect state. The present invention also provides a locking mechanism which provides the user with a positive feedback as to when the locking mechanism is engaged. The present invention also can be easily manufactured and is adaptable to many types of appliances, wall outlets and other uses.

The main aspect of the present invention is to provide a breakaway electric cord mechanism that can be used in connection with the base of an appliance. The term appliance as used herein is not limited to those kitchen appliances that might be easily supported by a counter top, but is also intended to refer broadly to other objects that are typically connected to a conventional wall plug by a length of electric cord, which cord presents the potential for injury or damage to property. The major components are a plug assembly, and engagement mechanism, and a base assembly. The term plug assembly is used here to refer in the most general sense to an assembly attached to or integral with one end of an electrical cord, the electrical cord having a plug for insertion into a conventional wall socket to provide a source of power. The term base assembly is used here to refer in the most general sense to an assembly designed to mate with a corresponding plug assembly in conjunction with the engagement mechanism of the present invention. The base assembly will generally be directly electrically connected to an electrical power consumption unit of an electrical appliance. These assemblies act in conjunction to provide a spring release of the assemblies from each other in the event of a tension, for example a tug, being applied to the cord greater than a preset minimum level sufficient to allow disengagement of the engagement mechanism. Since the plug assembly is separable from the base assembly, the separate assemblies can be color coordinated with each other. The plug assembly can be manufactured in a variety of color options to allow the consumer to match each portion of the assembly with the expected decorative environment in which the electrical appliance is to be employed.

In the most general case, the invention can be viewed as an electrical connector comprising a first assembly including a housing defining a cavity containing prongs suitable for connection to one portion of an electrical power delivery system, and an ejection plunger; a second assembly including a case containing electrical contacts for electrical connection with the prongs, the contacts being suitable for connection to another portion of the electrical power delivery system; and an engagement mechanism coupled to one of the first and second assemblies and engaging another of the first and second assemblies during a connection between the first and second assemblies, the engagement mechanism being releasable in the event of a tug on either assembly thereby enabling the ejection plunger to separate the first assembly from the second assembly.

More particularly, the invention can be viewed as an electrical connector comprising a first assembly including a housing defining a cavity containing prongs suitable for connection to one portion of an electrical power delivery system, and an ejection plunger; a second assembly including a case containing electrical contacts for electrical connection with the prongs, the contacts being suitable for connection to another portion of the electrical power delivery system; and a holder coupled to the second assembly and containing slidable receptacles for engaging the prongs of the first assembly and the electrical contacts of the second assembly, the holder carrying an engagement mechanism for engaging the cavity of the first assembly during a connection between the first and second assemblies, the second assembly being movable over a predetermined range relative to the holder in the event of a tug on either assembly thereby allowing disengagement of the engagement mechanism and enabling the ejection plunger to separate the first assembly from the holder and second assembly.

The first or base assembly includes a housing including a plug-receiving cavity. A set of prongs are situated wholly within the plug-receiving cavity of the housing so as not to project outward from the housing. The prongs can be electrically connected to the electrical power consumption unit of an electrical appliance by way of retention screws provided at a rear end of the base assembly. The ejection plunger or thrust mechanism consisting generally of a thrust spring and thrust spring plunger is located centrally within the base assembly. The thrust spring and thrust spring plunger are respectively contained within the base assembly housing via a slot or opening into which a plunger spring retention plate is fastened with two screws. The thrust spring plunger has tabs that extend laterally outward to prevent the thrust spring plunger from coming free from the base assembly housing under influence of the outward force of the thrust spring. Once assembled, the appliance base assembly contains the non-protruding contact pins and the thrust spring plunger in an extended position. The plunger resists the entrance of any foreign object between the contact pins. The thrust spring, in a non-compressed mode, can extend the thrust spring plunger beyond the extent of the electrical prongs within the assembly housing. The thrust spring plunger is preferably manufactured of a non-conductive material. The base assembly cavity also contains a recessed groove that captures the engagement mechanism.

The second assembly or plug assembly is a one-piece molded assembly consisting generally of a power line cord, conductive electrical contact pins electrically connected to the power line cord, and a non-conductive case. The power line cord can include a standard wall plug connector at one end, or can have a specialty connector if so desired. The electrical contact pins are preferably similar in design to standard electrical plug prongs, but could have special conformation, if required. The body or case also includes external tabs or positive snaps for mating with the holder of the engagement mechanism.

The engagement mechanism holder is designed to couple to the end plug assembly. Once assembled to the plug assembly the holder provides both an electrical contact and a mechanical coupling between the first and second assemblies. The holder consists of a molded body or case with locking slot tracks that engage the external tabs of the second or plug assembly. The holder also contains electrical socket conductors designed to accommodate prongs or pins at either end. The engagement mechanism consists of a lock engagement spring retained to the holder by a retention pin or set screw. The spring is generally V-shaped with arms extending outward but generally parallel to each other from the top of the V-shaped spring. The holder slides with respect to the end plug assembly The mating of the plug end assembly to the base assembly causes the thrust spring within the thrust plunger to be compressed by the force exerted upon mating. As the end of the engagement mechanism holder contacts the innermost surface of the base assembly, the molded end plug assembly will move towards the base assembly and relative to the engagement mechanism holder. The range of relative movement that occurs between the molded plug and the engagement mechanism holder is limited by the length of the slots receiving the tabs on the end plug assembly. At the point where the lock engagement spring comes into contact with a slanted exterior shoulder of the second assembly, the locking engagement spring is forced to move outward where it is received in grooves on the interior surface of the first assembly cavity. As further pressure is applied, a flat exterior shoulder of the second assembly slips under the engagement spring arms thereby blocking the inward return of the arms thereby locking the engagement assembly to the first assembly. Known engineering design controls the side pinching force of the prong receptacles contacts and the lock engagement spring pressure against the outer flat exterior shoulder of the second assembly. The pressure of the thrust spring and the thrust spring plunger is transferred through the lock engagement spring into the first assembly housing. The thrust plunger maintains a potential energy stored in its compression spring for use upon release of the locking engagement spring. It will be appreciated that the spring locking force can be varied with the design requirements via spring parameter selection.

When a force above an minimum level is exerted on the cord, the molded plug or second assembly moves within the locking slot tracks of the locking assembly housing. After a small but predetermined amount of travel, the outer flat exterior shoulder is withdrawn sufficiently to permit the engagement spring to collapse into its original, relaxed or static position and out of engagement with the base recessed groove. With this action taking place no further locking pressure is retained. The stored force of the compressed thrust spring now pushes the thrust plunger to eject the entire second assembly and engagement housing. The thrust spring plunger acts over a length greater than the prongs of the base assembly. This action assures that the entire second assembly and engagement housing is completely ejected. The ejection terminates both physical and electrical contact between the first assembly and the entire second assembly and engagement housing combination.

Other features, aspects and advantages of this invention will become apparent from the following description of the preferred embodiment which references the accompanying drawings forming a part of this specification wherein like reference characters designate corresponding parts in the several views.

DETAILED DESCRIPTION OF A PREFERRED EMBODIMENT

Figure 1:
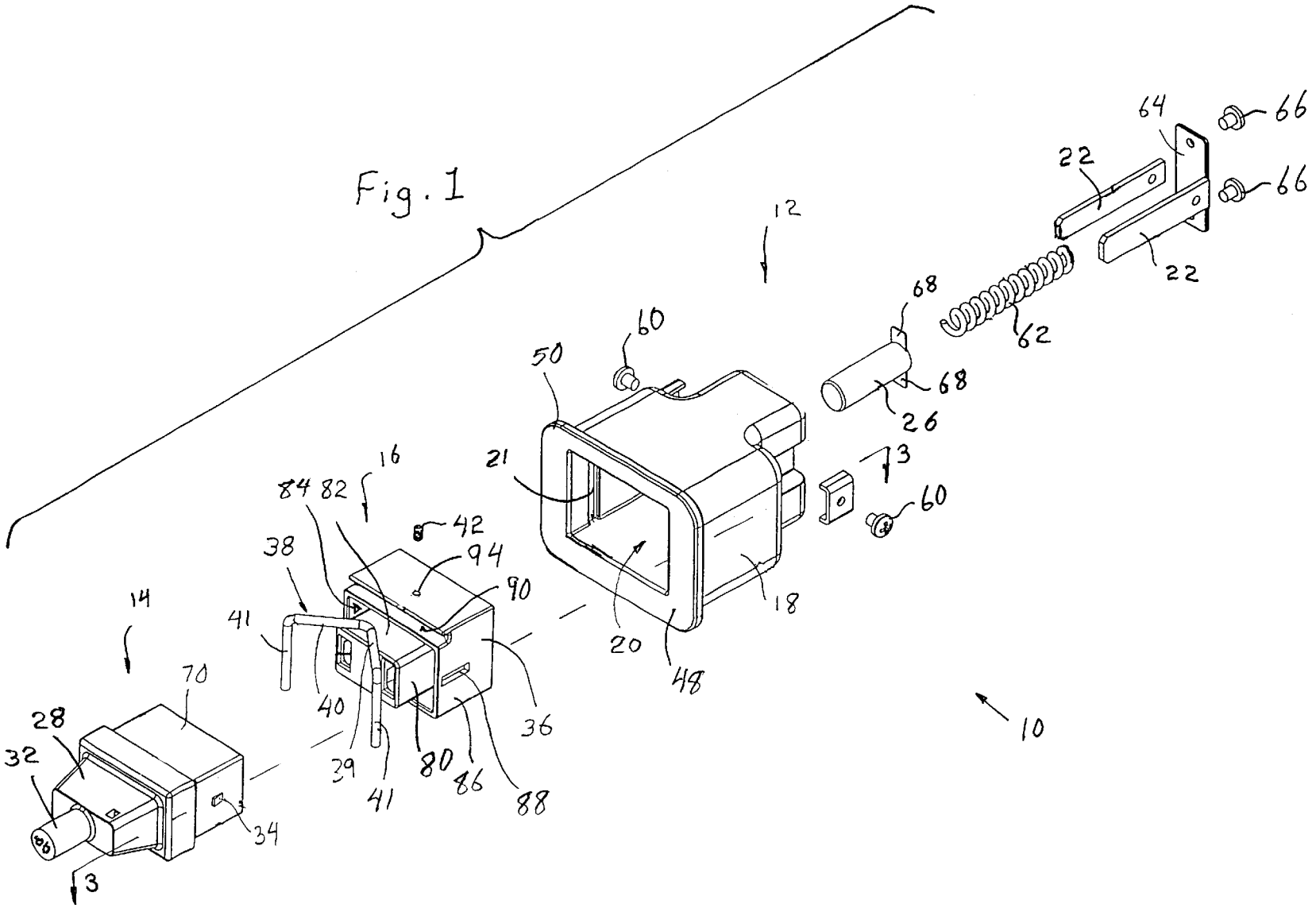
FIG. 1 shows an exploded perspective view of an electrical connector of the present invention viewed from the second assembly end.
Figure 2:
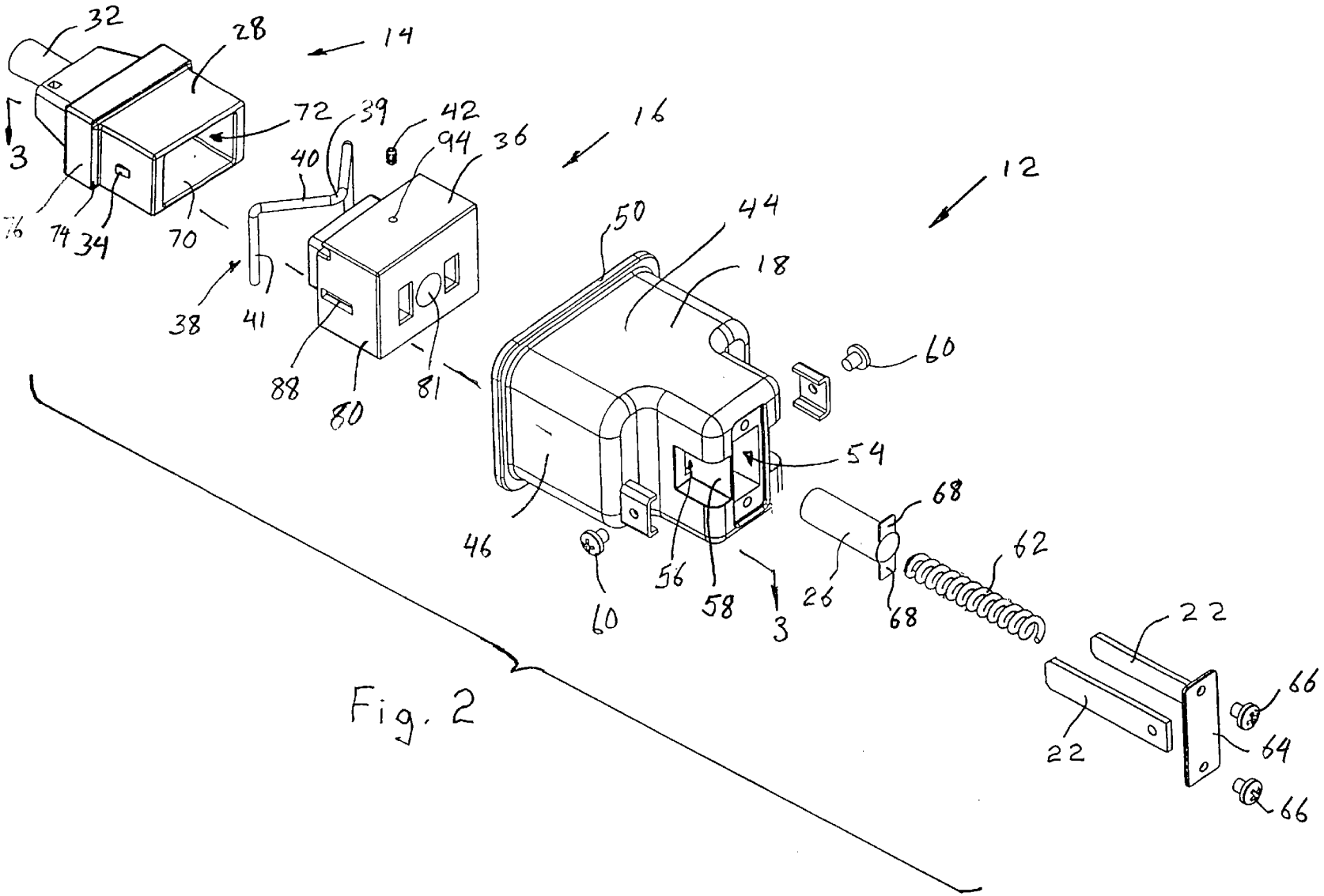
FIG. 2 is similar to FIG. 1 but viewed from the first assembly end.
Figure 3:
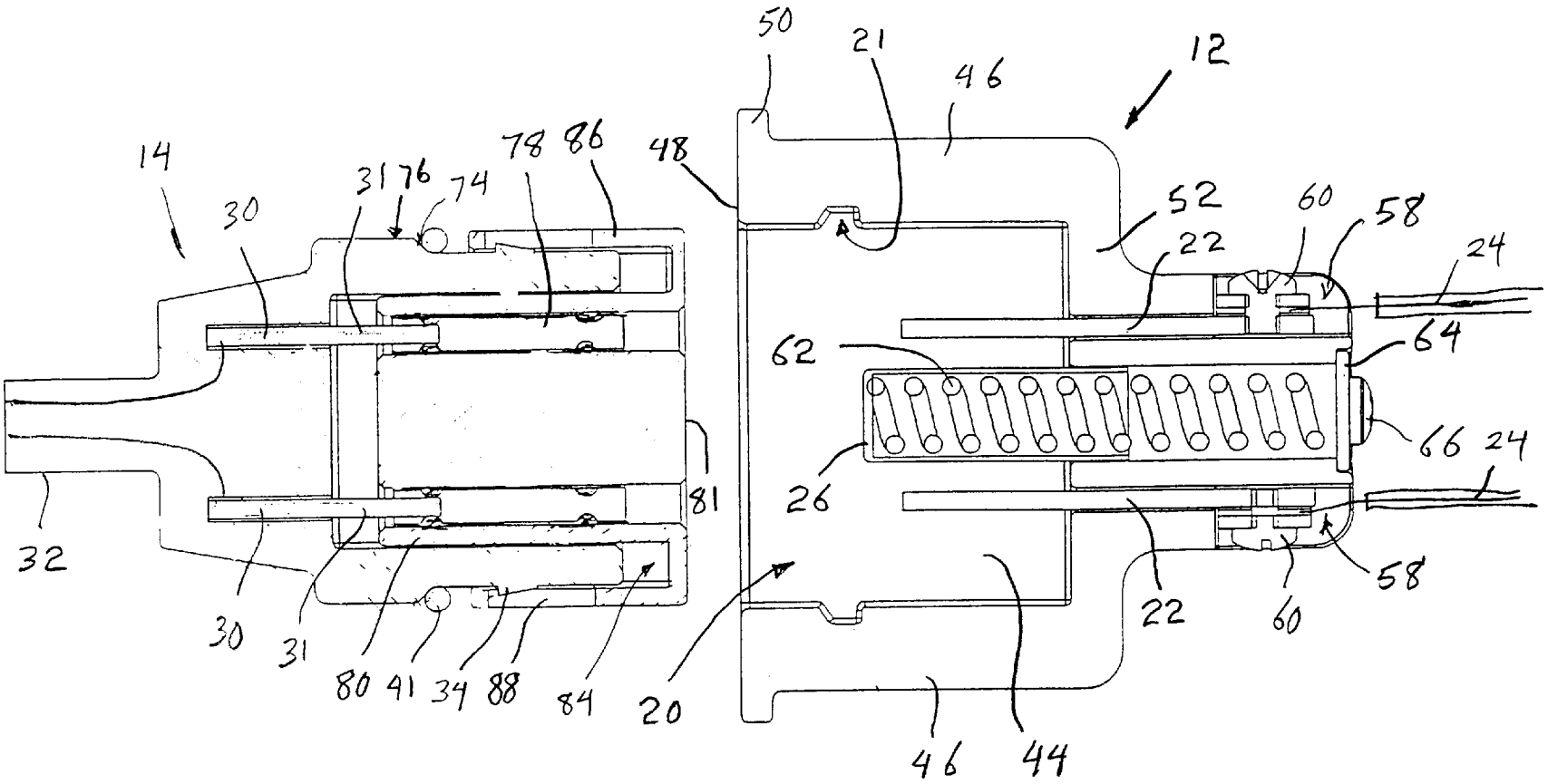
FIG. 3 is a cross-sectional view of an electrical connector of the present invention taken along lines 3—3 of FIG. 2 showing the assemblies fully separated from each other.

A preferred embodiment of an electrical connector 10 of the present invention in FIGS. 1–7 to be formed by a first assembly 12, and second assembly 14 and an engagement assembly 16. As a general overview, the first assembly 12 includes a housing 18 defining a cavity 20 having grooves 21 and containing prongs 22 suitable for connection to one portion 24 of an electrical power delivery system. The first assembly also includes an ejection plunger 26. The second assembly 14 includes a case or body 28 containing electrical contacts 30, the contacts 30 being connected to another portion 32 of the electrical power delivery system. The second assembly 14 includes protrusions or tabs 34 projecting laterally outward from the sides of the body 28. The engagement assembly 16 includes a holder 36 containing electrical sockets intended to receive and electrically connect prongs 22 of the first assembly 12 and contacts 30 of the second assembly 14. The engagement assembly 16 also includes an engagement mechanism 38 in the form of spring 40 that is coupled to the holder 36 by fastener 42. The engagement mechanism 38 can be engaged in grooves 21 in cavity 20 of the first assembly 12. The engagement mechanism 38 is releasable from the grooves 21 in the event of a tug on either assembly thereby enabling the ejection plunger 26 to separate the first assembly 12 from the second assembly 14.

In more detail, the first assembly 12 comprises a housing 18 of molded electrically non-conductive plastic or rubber, the composition of which can be chosen from many suitable materials that are well know in the trade, the selection of which forms no part of this invention. The cavity 20 within the housing 18 is defined by upper and lower walls 44 and lateral walls 46. The groves 21 are included as a molded feature of lateral walls 46. The walls 44 and 46 have a forward edge 48 that extends outward as a flange 50. The flange 50 can terminate in a smooth surface as shown, or can be configured as necessary to form a continuing surface with a cover of an appliance base in which the housing 18 is to be fixed. The particular shape of the flange 50 is subject to significant variation in design and forms no part of the present invention. The housing 18 includes a rear wall 52, as shown in FIGS. 3–7, that has an opening 54 to receive the ejection plunger 26 and slots 56 to receive prongs 22. The rear wall 52 also includes a rearward projection having lateral openings 58 for receiving terminal connections 60 engaging the prongs 22 and adapted to be connected to an electrical circuit, particularly a power consuming unit of an electrical appliance in which the first assembly 12 is mounted. A forward end of a compression spring 62 is received within ejection plunger 26 while a rearward end of the compression spring is confined by backing plate 64 fixed to rear wall 52 by retaining fasteners 66. The ejection plunger 26 includes outwardly extending tabs 68 that contact an abutting surface adjacent a forward end of opening 54 to restrict any further forward movement of the ejection plunger 26 than is illustrated generally in FIGS. 3 and 6.

The body 28 of the second assembly 14 is also molded of electrically non-conductive plastic or rubber, which need not be the same material as that forming the housing 18 of the first assembly 12, the composition of which can be chosen from many suitable materials that are well know in the trade, the selection of which forms no part of this invention. The body 28 is preferably molded to an end of an electrical power cord 32, the other end of which can have another electrical connector, not illustrated, the design or which forms no part of the present invention. The body 28 includes a perimeter wall 70 that includes on an outer surface the protrusions or tabs 34 that engage the engagement assembly 16. The perimeter wall 70 defines a cavity 72 containing a projecting portion 31 of the electrical contacts 30, the contacts 30 being connected to electrical conductors within the power cord 32. The outer surface of the perimeter wall 70 includes an inclined portion 74, and a flat exterior portion 76 that interacts with the spring 40 of engagement mechanism 38.

The engagement assembly 16 includes a holder body 80 having a central portion 82 containing electrical socket conductors 78 which can electrically couple the prongs 22 of the first assembly 12 to the electrical contacts 30 of the second assembly 14. The central portion 82 of the holder 80 is surrounded by a channel 84 that receives the perimeter wall 70 of the second assembly 14. The channel 84 is bounded by an outer wall 86 that is molded with the central portion 82. The outer wall includes slots 88 that receive the protrusions or tabs 34 of the second assembly and act to define the limits of relative movement between the engagement assembly 16 and the second assembly 14. One side of the outer wall 86 also includes a groove 90 that receives the V-shaped portion 39 of spring 40. The spring 40 also includes leg portions 41 that laterally straddle, and are outwardly spaced from, the central portion 82 of the engagement assembly 16 so that they can engage the grooves 21 of the first assembly 12 in the manner hereafter described. The fastening pin or screw 42 is received in opening 94 in the outer wall 86, and projects through the groove 90 to retain the spring 40 within the groove 90. Like the first and second assemblies, the engagement assembly 16 is molded of electrically non-conductive plastic or rubber, the composition of which can be chosen from many suitable materials that are well know in the trade, need not be the same as either the first or second assemblies, and the selection of which forms no part of this invention.

Subsequent to the separate manufacture of the first, second, and engagement assemblies, one of the first assemblies 12 can be incorporated into an electrical circuit or device for which the protection of the present invention is desired. A second assembly 14 is coupled to an engagement assembly 16 by merely telescoping the two assemblies together to the position shown in FIGS. 3 and 6. In this position, the electrical contacts 30 of the second assembly 14 are in sliding engagement with the socket conductors 78 of the engagement assembly 16. Additionally, the leg portions 41 of the engagement spring 40 are situated on the outer surface of perimeter wall 70 adjacent the inclined portions 74. Once the second assembly 14 is telescoped into engagement with the engagement assembly 16, the protrusions or tabs 34 become engaged in slots 88 that act to define the limits of relative movement between the assemblies 14 and 16.

Figure 4:
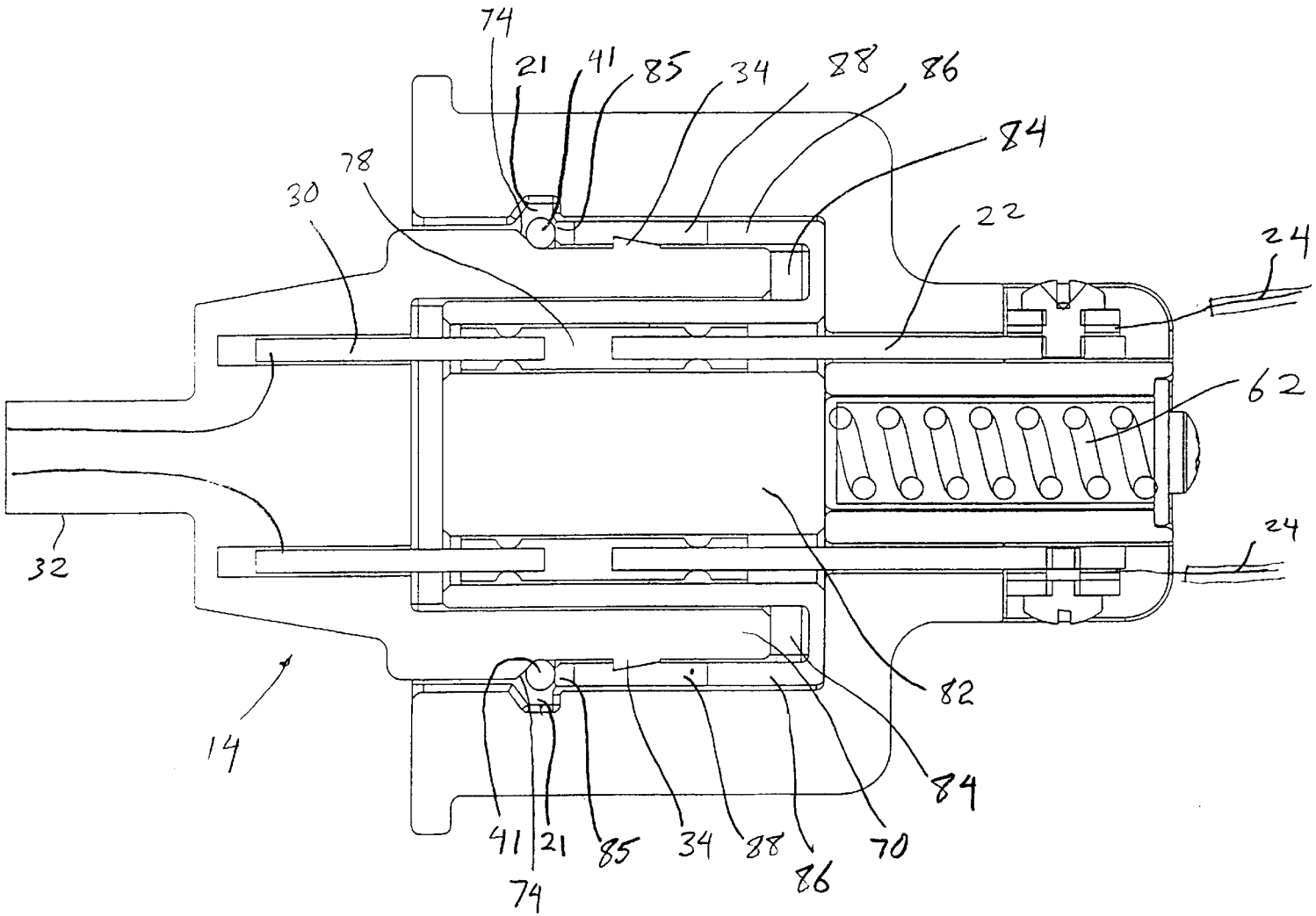
FIG. 4 is a cross-sectional view similar to FIG. 3 showing the assemblies engaged with each other, but not locked by the engagement mechanism.
Figure 5:
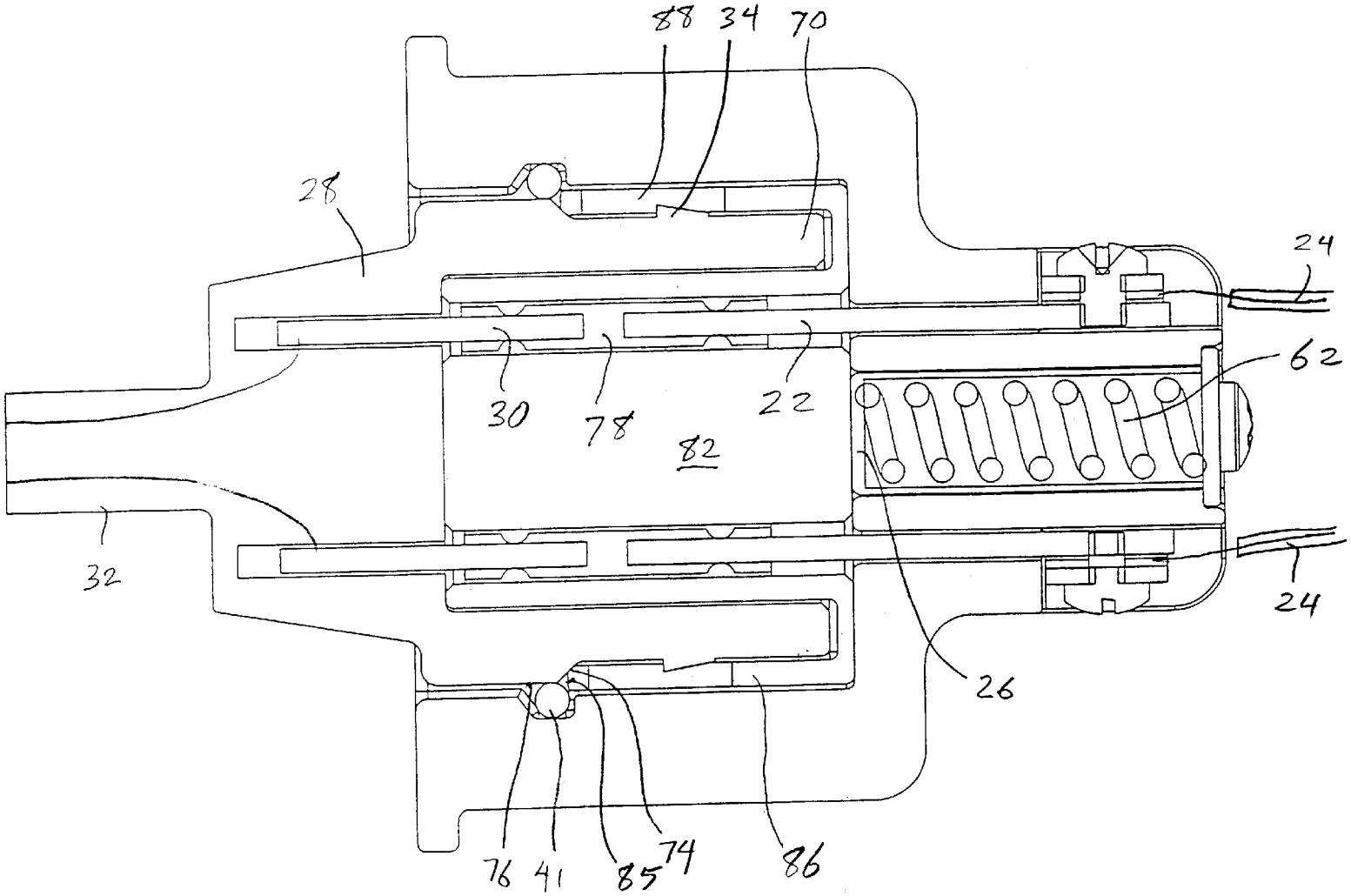
FIG. 5 is a cross-sectional view similar to FIGS. 3 and 4 showing the assemblies locked to each other by the engagement mechanism.
Figure 6:
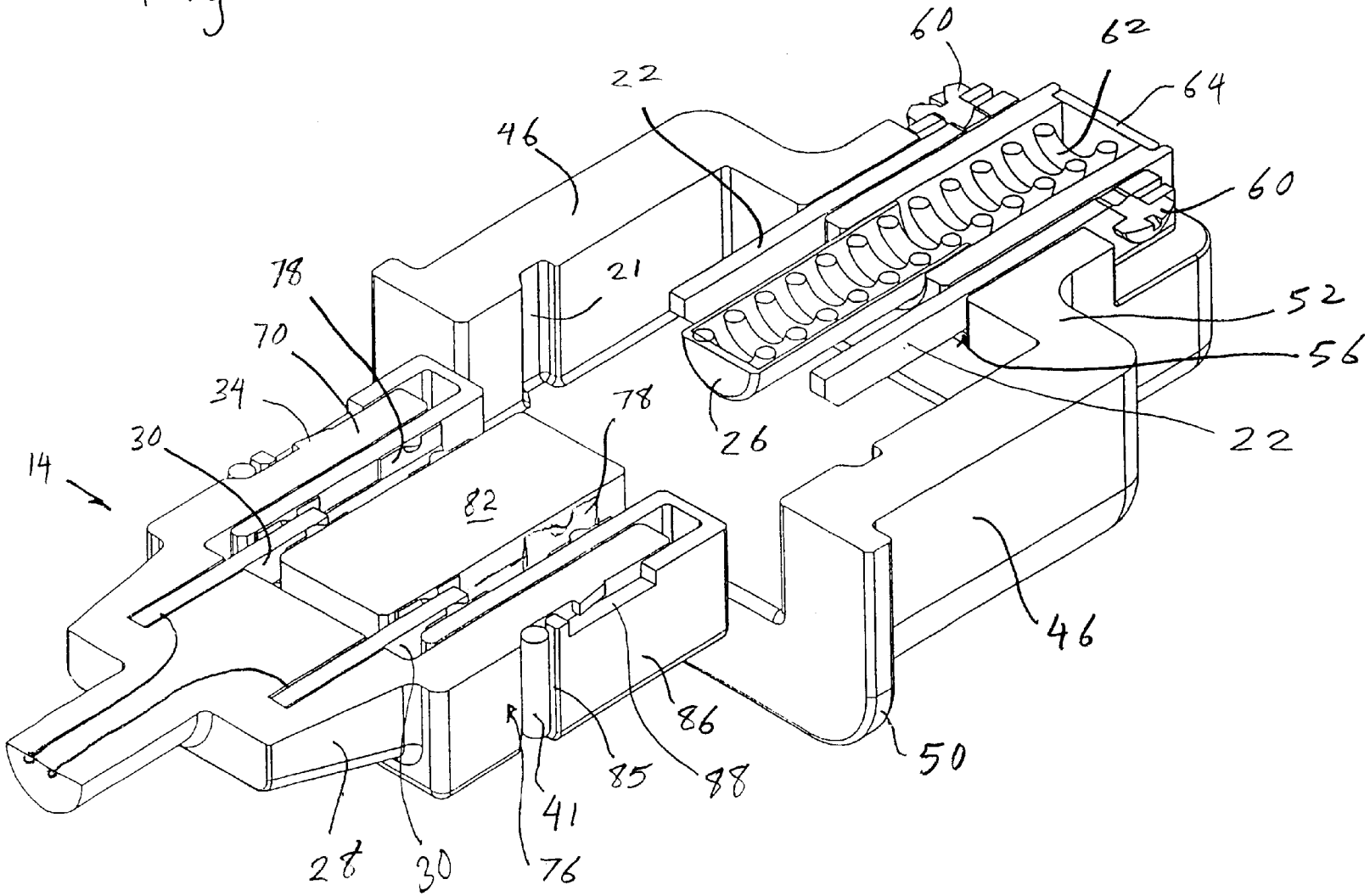
FIG. 6 is a perspective cross-sectional view of the electrical connector taken along lines 3—3 of FIG. 2 and shown in a state similar to FIG. 3.
Figure 7:
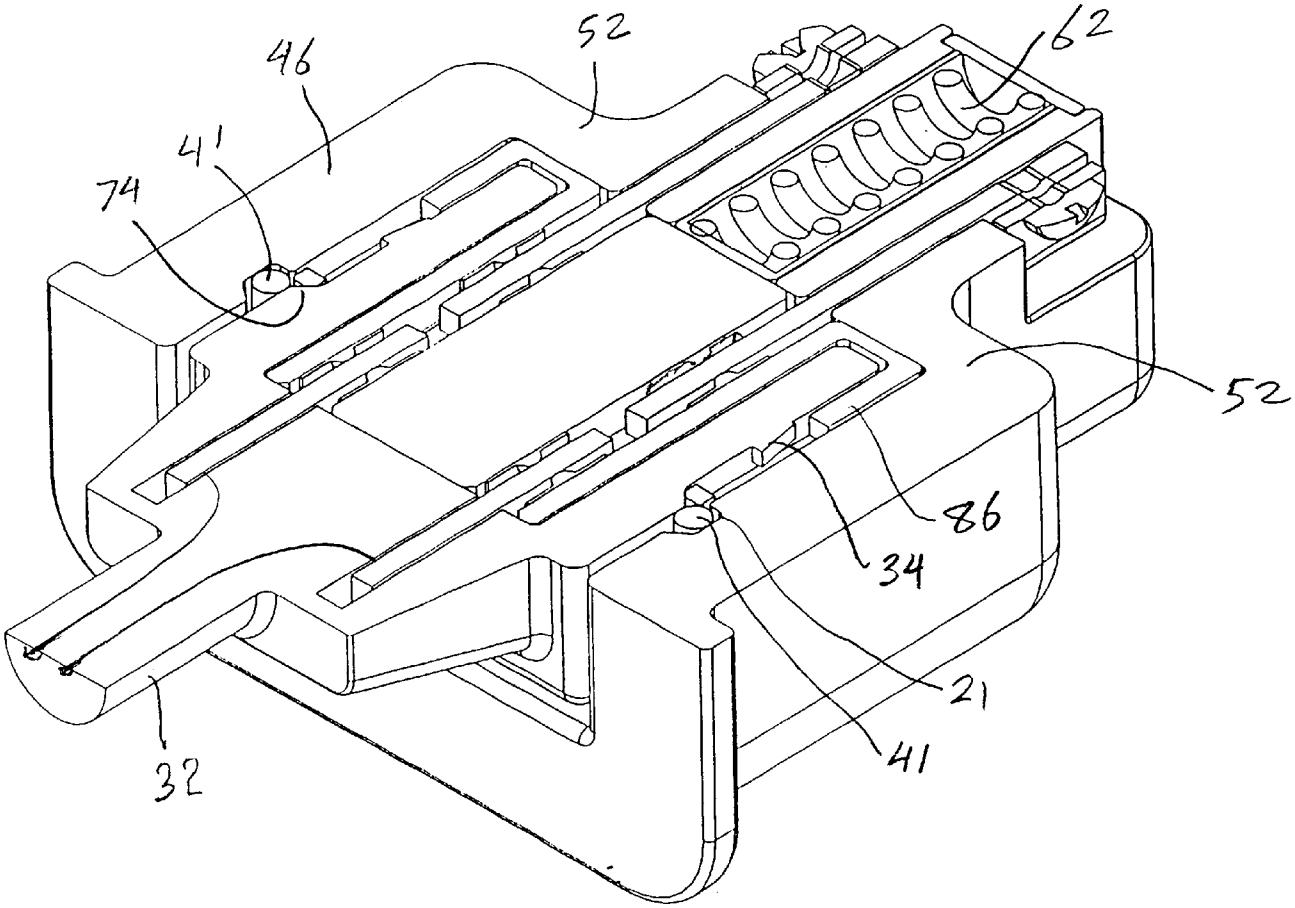
FIG. 7 is a perspective cross-sectional view similar to FIG. 6, but with the electrical connector in a state similar to FIG. 5.

The combined assemblies 14 and 16 can then be inserted into the cavity 20 of first assembly 12 to the point shown in FIG. 4. As this insertion takes place, the front face 81 of the central portion 82 of the engagement assembly 16 pushes against ejection plunger 26 thereby compressing ejection spring 62, which has the effect of storing potential energy in the spring for use in separating the assemblies of the present invention in the intended manner. As additional force is applied to the second assembly 14 to force it in engagement with the first assembly 12, a projecting edge 85 of outer wall 86 contacts legs 41 and forces the legs 41 to move laterally out the inclined portions 74 of body 28 and into grooves 21 on the interior of cavity 20 of the first assembly 12. As the legs 41 are completely received into the grooves 21, the flat exterior portions 76 of body 28 slide between the legs 41 to the point illustrated in FIGS. 5 and 7. In this position, The flat exterior portions 76 of the second assembly body 28 block any disengagement of the legs 41 from the grooves 21, thereby firmly coupling the entire electrical connector 10 together. The second assembly 16 is retained in the position shown in FIGS. 5 and 7 merely by the frictional engagement between the electrical contacts 30 and the socket conductors 78 of the engagement assembly 16, and the frictional engagement between the legs 41 and the flat exterior portions 76 of second assembly body 28.

In the event of a tug or pull on one end or another of the fully assembled electrical connector 10 that exceed the frictional forces holding the second assembly 14 immobile with respect to the engagement assembly 16, the second assembly 14 will move outward relative to the engagement assembly 16 to the point that the legs 41 of spring 40 can collapse inward disengaging from grooves 21. At this point, the energy stored in spring 40 is sufficient to overcome the frictional forces between the socket conductors 78 of the engagement assembly 16 and the prongs 22 of the first assembly 12, thereby causing the forced ejection of the second assembly 14 and engagement assembly 16 from the cavity 20 of the first assembly 12. The ejection forces are supplied by the ejection spring 40 and not by the force of the initial tug or pull that triggers the ejection.

As indicated previously, the body 28 is preferably molded to an end of an electrical power cord 32, the other end of which can have another electrical connector, not illustrated. The particular design of the non-illustrated electrical connector can be entirely conventional. Since the body 28 and electrical power cord 32 is separable from the base assembly 12, the separate assemblies can be color coordinated with each other. The plug assembly 14 can be manufactured in a variety of color options to allow the consumer to match each portion of the assembly with the expected decorative environment in which the electrical appliance is to be employed. Preferably the engagement assembly 16 is made of a contrasting color to provide a visual indicator of plug assembly disengagement. Additionally, the electrical power cord 32 of the assembly can be manufactured in a variety of lengths to provide the purchaser with a variety for selection of a length most suitable to the ultimate location of use.

Although the present invention has been described with reference to a preferred embodiment, numerous modifications and variations can be made within the scope of the invention. No limitation with respect to the specific embodiments disclosed herein is intended or should be inferred unless specifically claimed. It is to be understood that the invention is not limited in its application to the details of the particular arrangement shown, since the invention is capable of other embodiments.

What is claimed is:

1. An electric connector comprising:

a first assembly including a housing a cavity containing prongs suitable for connection to one portion of an electrical power delivery system, and an ejection plunger;

a second assembly including a case containing electrical contacts for electrical connection with the prongs, the contacts being suitable for connection to another portion of the electrical power delivery system; and an engagement mechanism in the form of two arms of a single spring coupled to the second assembly and engaging the first assembly during a connection between the first and second assemblies, the engagement mechanism being releasable in the event of a tug on either assembly thereby enabling the ejection plunger to separate the first assembly from the second assembly.

2. An electrical connector comprising:

a first assembly including a housing defining a cavity containing prongs suitable for connection to one portion of an electrical power delivery system, and an ejection plunger;

a second assembly including a case containing electrical contacts for electrical connection with the prongs, the contacts being suitable for connection to another portion of the electrical power delivery system; and an engagement mechanism comprising locking elements coupled to the second assembly and engaging the first assembly during a connection between the first and second assemblies, the first assembly including detents within the cavity to engage the locking elements, the engagement mechanism being releasable in the event of a tug on either assembly thereby enabling the ejection plunger to separate the first assembly from the second assembly.

3. An electrical connector comprising:

a first assembly including a housing defining a cavity containing prongs suitable for connection to one portion of an electrical power delivery system, and an ejection plunger;

a second assembly including a case containing electrical contacts for electrical connection with the prongs, the contacts being suitable for connection to another portion of the electrical power delivery system; and an engagement mechanism in the form of locking elements coupled to the second assembly and engaging the first assembly during a connection between the first and second assemblies, the first assembly including a detent within the cavity to engage the locking elements, a shoulder movable with respect to the locking elements to expand the locking elements into the detent to form a positive lock between the first and second assemblies, the engagement mechanism being releasable in the event of a tug on either assembly thereby enabling the ejection plunger to separate the first assembly from the second assembly.

4. An electrical connector comprising:

a first assembly including a housing defining a cavity containing prongs suitable for connection to one portion of an electrical power delivery system, and an ejection plunger;

a second assembly including a case containing electrical contacts for electrical connection with the prongs, the contacts being suitable for connection to another portion of the electrical power delivery system; and an engagement mechanism coupled to one of the first and second assemblies and engaging another of the first and second assemblies during a connection between the first and second assemblies, the engagement mechanism including a holder containing slidable receptacles for engaging the prongs of the first assembly and the electrical contacts of the second assembly, the engagement mechanism being releasable in the event of a tug on either assembly thereby enabling the ejection plunger to separate the first assembly from the second assembly.

5. An electrical connector comprising:

a first assembly including a housing defining a cavity containing prongs suitable for connection to an appliance electrical consumption unit, and an ejection plunger;

a second assembly including a case containing electrical contacts for electrical connection to the prongs, the electrical contacts being connected to electrical conductors within an electrical power cord; and a holder coupled to the second assembly and containing slidable receptacles for engaging the prongs of the first assembly and the electrical contacts of the second assembly, the holder carrying an engagement mechanism for engaging the cavity of the first assembly during a connection between the first and second assemblies, the holder including a locking slot engaging a tab on the case of the second assembly for limiting the movement of the holder relative to the second assembly case, the engagement mechanism being releasable in the event of a tug on either assembly thereby enabling the ejection plunger to separate the first assembly from the second assembly.

6. An electrical connector comprising:

a first assembly including a housing defining a cavity containing prongs suitable for connection to an appliance electrical consumption unit, and an ejection plunger including an ejection spring;

a second assembly including a case containing electrical contacts for electrical connection to the prongs, the electrical contacts being connected to electrical conductors within an electrical power cord; and a holder coupled to the second assembly and containing slidable receptacles for engaging the prongs of the first assembly and the electrical contacts of the second assembly, the holder carrying an engagement mechanism for engaging the cavity of the first assembly during a connection between the first and second assemblies, the engagement mechanism being releasable in the event of a tug on either assembly thereby enabling the ejection plunger to separate the first assembly from the second assembly;

wherein the ejection spring has a spring constant selected to provide a separation force that is less than a combination of forces arising from the engagement between said slidable receptacles of the holder and the prongs of the first assembly and the engagement of the engagement mechanism with the cavity of the first assembly, but greater than merely the forces arising from the engagement between said slidable receptacles of the holder and the prongs of the first assembly.

7. An electrical connector comprising:

a first assembly including a housing defining a cavity containing prongs suitable for connection to an appliance electrical consumption unit, an ejection plunger, an opening from a back side into said cavity, the ejection plunger being received in said opening, the first assembly further including a spring having a first end received within the ejection plunger and a retention plate fixed to the first assembly back side, the retention plate contacting a second end of the spring;

a second assembly including a case containing electrical contacts for electrical connection to the prongs, the electrical contacts being connected to electrical conductors within an electrical power cord; and a holder coupled to the second assembly and containing slidable receptacles for engaging the prongs of the first assembly and the electrical contacts of the second assembly, the holder carrying an engagement mechanism for engaging the cavity of the first assembly during a connection between the first and second assemblies, the engagement mechanism being releasable in the event of a tug on either assembly thereby enabling the ejection plunger to separate the first assembly from the second assembly.

8. An electrical connector comprising:

a first assembly including a housing defining a cavity containing prongs suitable for connection to one portion of an electrical power delivery system, and an ejection plunger;

a second assembly including a case containing electrical contacts for electrical connection with the prongs, the contacts being suitable for connection to another portion of the electrical power delivery system; and a holder coupled to the second assembly and containing slidable receptacles for engaging the prongs of the first assembly and the electrical contacts of the second assembly, the holder carrying an engagement mechanism for engaging the cavity of the first assembly during a connection between the first and second assemblies, the second assembly being movable over a predetermined range relative to the holder in the event of a tug on either assembly thereby allowing disengagement of the engagement mechanism and enabling the ejection plunger to separate the first assembly from the holder and second assembly.

9. An electrical connector comprising:

a first assembly including a housing defining a cavity containing prongs suitable for connection to an appliance electrical consumption unit, and an ejection plunger;

a second assembly including a case containing electrical contacts for electrical connection to the prongs, the electrical contacts being connected to electrical conductors within an electrical power cord; and a holder coupled to the second assembly and containing slidable receptacles for engaging the prongs of the first assembly and the electrical contacts of the second assembly, the holder carrying an engagement mechanism for engaging the cavity of the first assembly during a connection between the first and second assemblies, the engagement mechanism being releasable in the event of a tug on either assembly thereby enabling the ejection plunger to separate the first assembly from the second assembly.

10. The electrical connector of claim 9, wherein the holder is formed of a material having a color that is different from at least one of the first and second assemblies to provide a visual indication of disengagement.

11. An electrical connector comprising:

a first assembly including a housing defining a cavity containing prongs suitable for connection to an appliance electrical consumption unit, and an ejection plunger;

a second assembly including a case containing electrical contacts for electrical connection to the prongs, the electrical contacts being connected to electrical conductors within an electrical power cord; and a holder coupled to the second assembly and containing slidable receptacles for engaging the prongs of the first assembly and the electrical contacts of the second assembly, the holder carrying an engagement mechanism for engaging the cavity of the first assembly during a connection between the first and second assemblies, the engagement mechanism including locking elements formed by two arms at the end of a single V-shaped spring, and, wherein the first assembly housing further comprises detents within the cavity to engage the locking elements, the engagement mechanism being releasable in the event of a tug on either assembly thereby enabling the ejection plunger to separate the first assembly from the second assembly.

12. The electrical connector of claim 11, wherein the holder further comprises a shoulder on the holder movable with respect to the locking elements to expand the locking elements into the detents to form a positive lock between the first and second assemblies.

13. The electrical connector of claim 11, wherein the holder further comprises a surface confronting the ejection plunger compressing the ejection plunger upon the connection of the first and second assemblies, and a retaining fastener coupling the V-shaped spring to the holder.

14. An electrical connector comprising:

a first assembly including a housing defining a cavity containing prongs suitable for connection to one portion of an electrical power delivery system, and an ejection plunger;

a second assembly including a case containing electrical contacts for electrical connection with the prongs, the contacts being suitable for connection to another portion of the electrical power delivery system;

a holder coupled to the second assembly and containing slidable receptacles for engaging the prongs of the first assembly and the electrical contacts of the second assembly, the holder carrying an engagement mechanism for engaging the cavity of the first assembly during a connection between the first and second assemblies, the second assembly being movable over a predetermined range relative to the holder in the event of a tug on either assembly thereby allowing disengagement of the engagement mechanism and enabling the ejection plunger to separate the first assembly from the holder and second assembly; and wherein the first assembly further comprises detents within the cavity to engage the engagement mechanism, an opening from a back side into said cavity, the ejection plunger being received in said opening, a spring having a first end received within the ejection plunger and a retention plate fixed to the first assembly back side, the retention plate contacting a second end of the spring, the prongs being sufficient short as to be wholly confined within the cavity.

15. The electrical connector of claim 14, wherein second assembly further comprises tabs projecting outward from the case to engage the holder, the electrical contacts being sized to be continuously received in the slidable receptacles of the holder over the predetermined range of movement of the holder relative to the second assembly.

16. The electrical connector of claim 15, wherein the engagement mechanism further comprises locking elements formed by two arms at the end of a single V-shaped spring, and the holder further comprises a shoulder on the holder movable with respect to the locking elements to expand the locking elements into the detents to form a positive lock between the first and second assemblies, a surface confronting the ejection plunger compressing the ejection plunger upon the connection of the first and second assemblies, a retaining fastener coupling the V-shaped spring to the holder, and a pair of locking slots engaging the tabs on the case of the second assembly for limiting the movement of the holder relative to the second assembly case.

17. The electrical connector of claim 16, wherein the engagement mechanism holder is formed of a material having a color that is different from at least one of the first and second assemblies to provide a visual indication of disengagement.

18. An electrical connector comprising:

a first assembly including a housing defining a cavity containing prongs suitable for connection to one portion of an electrical power delivery system, and an ejection plunger;

a second assembly including a case containing electrical contacts for electrical connection with the prongs, the contacts being suitable for connection to another portion of the electrical power delivery system; and an engagement mechanism coupled to one of the first and second assemblies and engaging another of the first and second assemblies during a connection between the first and second assemblies, the engagement mechanism being releasable in the event of only a tug on either assembly thereby enabling the ejection plunger to separate the first assembly from the second assembly.

19. The electrical connector of claim 1 wherein the first assembly is fixed to the base of an electrical appliance, and the prongs are connected to an electrical consumption unit within the appliance.

20. The electrical connector of claim 1 wherein the second assembly is molded onto an end of an electrical power cable containing electrical power conductors, and the electrical contacts are connected to the electrical power conductors.

21. The electrical connector of claim 18, wherein the engagement mechanism is formed to have a color that is different from at least one of the first and second assemblies to provide a visual indication of disengagement.

22. The electrical connector of claim 18, wherein the engagement mechanism comprises locking elements coupled to the second assembly.

23. The electrical connector of claim 22, wherein the engagement mechanism engages the cavity of the first assembly.

* * * * *

UNITED STATES PATENT AND TRADEMARK OFFICE

CERTIFICATE OF CORRECTION

PATENT NO. : 6,364,675 B1
DATED : April 2, 2002
INVENTOR(S) : Brauer et al.

It is certified that error appears in the above-identified patent and that said Letters Patent is hereby corrected as shown below:

Column 7,
Line 51, replace the word “electric” with -- electrical --.

Column 12,
Line 32, replace the number “1” with the number -- 18 --.
Line 36, replace the number “1” with the number -- 18 --.

Signed and Sealed this

Twenty-fourth Day of September, 2002

*Attest:*

*Attesting Officer*

JAMES E. ROGAN
*Director of the United States Patent and Trademark Office*